US009845775B2

(12) United States Patent
Cuniberti et al.

(10) Patent No.: US 9,845,775 B2
(45) Date of Patent: Dec. 19, 2017

(54) INTAKE ASSEMBLY FOR AN INTERNAL COMBUSTION ENGINE

(71) Applicant: C.R.F. Societá Consortile per Azioni, Orbassano (Turin) (IT)

(72) Inventors: Marco Cuniberti, Orbassano (IT); Francesco Vattaneo, Orbassano (IT); Alessandro Gallone, Orbassano (IT); Luigi Guzzi, Orbassano (IT); Paolo Novella, Orbassano (IT); Caterina Venezia, Orbassano (IT); Rosario Nastro, Orbassano (IT)

(73) Assignee: C.R.F. SOCIETA CONSORTILE PER AZIONI, Orbassano (Turin)

( * ) Notice: Subject to any disclaimer, the term of this patent is extended or adjusted under 35 U.S.C. 154(b) by 124 days.

(21) Appl. No.: 13/657,405

(22) Filed: Oct. 22, 2012

(65) Prior Publication Data

US 2013/0104831 A1 May 2, 2013

(30) Foreign Application Priority Data

Oct. 27, 2011 (EP) ..... 11186880
Aug. 10, 2012 (EP) ..... 12180110

(51) Int. Cl.
*F02M 35/10* (2006.01)
*F02M 35/112* (2006.01)
(Continued)

(52) U.S. Cl.
CPC ..... *F02M 35/10308* (2013.01); *F02D 9/109* (2013.01); *F02D 9/1055* (2013.01);
(Continued)

(58) Field of Classification Search
USPC ..... 123/184.21, 184.61, 184.59, 184.44, 123/184.49, 184.26; 29/890.08, 890.052,
(Continued)

(56) References Cited

U.S. PATENT DOCUMENTS 5,181,491 A * 1/1993 Izumi et al. ..... 123/336
6,024,066 A * 2/2000 Nakayama et al. ..... 123/184.21
(Continued)

FOREIGN PATENT DOCUMENTS

DE 298 11 432 U1 9/1998
EP 1 666 716 A2 6/2006
EP 1 808 595 A2 7/2007

OTHER PUBLICATIONS

International Search Report for IEuropean Application No. 11186880.8, dated Mar. 27, 2012.

*Primary Examiner* — Carlos A Rivera
*Assistant Examiner* — Ruben Picon-Feliciano
(74) *Attorney, Agent, or Firm* — Heslin Rothenberg Farley & Mesiti P.C.; Victor A. Cardona, Esq.

(57) ABSTRACT

An intake assembly for an internal-combustion engine includes an intake duct for each cylinder, which communicates with an airbox that includes a filtering element. Each intake duct communicates with the airbox by a respective throttle body. A monitoring channel connects the intake ducts together and is configured for perturbing in a negligible way the dynamics of the fluid inside the intake ducts. Associated to said monitoring duct are sensors for monitoring the pressure inside the monitoring duct and designed to send signals indicating the value of pressure of the fluid taken in by the engine to an electronic control unit.

13 Claims, 6 Drawing Sheets

(51) Int. Cl.
*F02M 35/04* (2006.01)
*F02D 9/10* (2006.01)
*F02M 35/02* (2006.01)

(52) U.S. Cl.
CPC ..... *F02D 9/1095* (2013.01); *F02M 35/0203* (2013.01); *F02M 35/04* (2013.01); *F02M 35/044* (2013.01); *F02M 35/1038* (2013.01); *F02M 35/10052* (2013.01); *F02M 35/10072* (2013.01); *F02M 35/10111* (2013.01); *F02M 35/10255* (2013.01); *F02M 35/112* (2013.01); *F02M 35/048* (2013.01)

(58) Field of Classification Search
USPC ..... 29/890.09
See application file for complete search history.

(56) References Cited

U.S. PATENT DOCUMENTS

| | | | | |
|---|---|---|---|---|
| 6,227,172 | B1 * | 5/2001 | Katayama | F02D 9/1095 123/456 |
| 2006/0065225 | A1 * | 3/2006 | Shimatsu | 123/184.55 |
| 2006/0118086 | A1 * | 6/2006 | Schwulst et al. | 123/406.47 |

* cited by examiner

INTAKE ASSEMBLY FOR AN INTERNAL COMBUSTION ENGINE

CROSS-REFERENCE TO RELATED APPLICATIONS

This application claims priority to European Patent Application No. 11186880.8 filed on Oct. 27, 2011 and European Patent Application No. 12180110.4 filed on Aug. 10, 2012, the entire disclosures of which are incorporated herein by reference.

FIELD OF THE INVENTION

The present description relates to an intake assembly for an internal-combustion engine with controlled ignition comprising a plurality of cylinders, wherein the intake assembly comprises an intake duct for each cylinder of the internal-combustion engine and an airbox defining a volume with which each intake duct is in fluid communication.

GENERAL TECHNICAL PROBLEM

In internal-combustion engines in which air is supplied by natural induction, i.e., without the aid of a supercharging assembly, it is common practice to resort to "tuning" of the intake ducts in order to maximize the volumetric efficiency of the engine in a particular r.p.m. range, chosen according to the use for which the engine has been designed.

As is known to the person skilled in the branch, the term "tuning" is meant to indicate the choice of the geometry, in particular of the length and of the section of the ducts of the intake system in such a way that the pressure waves generated by the intake of fluid into the cylinders of the internal-combustion engine propagate within the intake assembly, enabling an increase of filling of the cylinders themselves (there is substantially obtained a sort of "natural supercharging").

In other words, the frequency of the pulses of the pressure waves that are generated in the intake system, which depends—among other things—upon the r.p.m. of the internal-combustion engine, is exploited as reference for the choice of the length of the ducts so as to have, at the moment of intake, a pressure wave that travels towards the cylinder, compressing the fluid at inlet to the cylinder itself. In this way, the mass of air that enters the cylinder is greater, a condition similar to what arises (of course for different reasons) with the action of a supercharging assembly on supercharged engines.

Usually, in the case where it is desired to increase the volumetric efficiency of the engine (hence the torque supplied) at high r.p.m., intake ducts of reduced length are used, whereas, in the case where it is desired to have a higher torque at low r.p.m., longer intake ducts are used.

The latter choice is preferred on cars that, owing to their characteristics and their purposes of use, envisage an operation of the engine in the medium-to-low r.p.m. range (i.e., a fair share of the cars with natural-induction engine in circulation, with the exception, for example, of higher-performance models of cars).

FIG. 1 is a schematic illustration of an intake assembly 1 of a known type coupled to an internal-combustion engine 2, comprising a plurality of cylinders CY. It should be noted that in this embodiment the internal-combustion engine 2 comprises two cylinders CY (here represented by way of example with cylinder head having four valves per cylinder), but it remains understood that the present description applies to any engine, regardless of the number of cylinders and the number of intake and exhaust valves.

The intake assembly 1 comprises, for each cylinder CY of the internal-combustion engine 2, an intake duct 4 in fluid communication with (and connected to) an airbox 6. Moreover installed on the airbox 6 is a throttle body 8 including a throttle valve 10. The throttle body 8 is in fluid communication with the external environment by means of an intake line 12 on which a filter element 14 is installed, which is in turn connected to an intake mouth 16 of the internal-combustion engine 2. As is known to the person skilled in the branch, the intake assembly 1 is coupled to the internal-combustion engine 2 in such a way that each intake duct 4 is in fluid communication with the corresponding cylinder CY. The airbox 6 and the filter element 14 introduce two localized capacities within the intake assembly 1.

During operation of the internal-combustion engine 2, the air is taken in through the intake mouth 16, traverses the filter element 14, the intake line 12, and the throttle body 8, to reach the airbox 6, from which it can be sent on towards the ducts 4. By regulating the position of the throttle valve 10 it is possible, as is known, to regulate the amount of air taken in by the engine 2.

The position of the airbox 6 downstream of the throttle body 8 varies tuning of the intake assembly 1.

In fact, to obtain a good tuning effect it is necessary for one end of the intake duct (in this case the duct 4) to present an expansion (in this case the airbox 6) that is sufficiently large to determine a decoupling with the circuit upstream of the duct, with the consequent reflection of the resonant waves in the duct itself.

In a traditional system like the one represented in FIG. 1, the volume of the airbox 6 cannot be increased sufficiently to enable a satisfactory decoupling in so far as by so doing the volume of fluid "under throttle" (i.e., the volume of fluid comprised between the throttle body and the intake valves) would be too large, with the consequent unacceptable slowness in the dynamics of control of the air at inlet to the engine.

It follows that the system has a weak tuning for the frequency corresponding to the resonance frequency of the ducts 4, on account of the contained volume of the airbox 6, but at the same time also has a weak tuning at the resonance frequency of the entire system up to expansion of the filter element 14 in so far as the volume of the airbox 6 has acted as decoupling element.

This is an evidently undesirable effect since the design effort for the development of intake ducts is in part nullified by a reduction of the volumetric efficiency of the internal-combustion engine 2, and hence of the torque supplied.

Any one of the documents Nos. U.S. Pat. No. 5,181,491 A and EP 1 808 595 A2 shows an intake assembly according to the preamble of Claim 1, i.e., in which said airbox is in fluid communication with the external environment by means of an intake mouth and includes, inside it, a filtering element designed for filtering a flow of fluid taken in by the internal-combustion engine, each of said intake ducts being in fluid communication with said airbox by means of a respective throttle body including a throttle valve, operable for adjusting a flow of fluid taken in by the internal-combustion engine.

OBJECT OF THE INVENTION

The object of the invention is to overcome the technical problems described previously.

In particular, the object of the invention is to provide an intake assembly for an internal-combustion engine that will enhance tuning of the intake ducts, by increasing the volumetric efficiency, and that at the same time will enable a simple and efficient control of the engine operating conditions.

SUMMARY OF THE INVENTION

The object of the invention is achieved by an intake assembly for an internal-combustion engine having the characteristics forming the subject of the ensuing claims, which form an integral part of the technical teaching provided herein in relation to the invention.

In particular, the object of the invention is achieved by an intake assembly of the type indicated above, in which the intake assembly comprises one intake duct for each cylinder of the internal-combustion engine, and an airbox defining a volume with which each intake duct is in fluid communication, said airbox being in fluid communication with the external environment by means of an intake mouth, and comprising, inside it, a filter element designed for filtering a flow of fluid taken in by the internal-combustion engine, each of the intake ducts being in fluid communication with the airbox by means of a respective throttle body including a throttle valve operable for regulating a flow rate of fluid taken in by the internal-combustion engine, said intake assembly being characterized in that it includes:

a monitoring channel that connects said intake ducts together, configured for perturbing in a negligible way the dynamics of the fluid inside the intake ducts, and pressure and temperature sensor means associated to said monitoring duct for monitoring the pressure and temperature inside said monitoring duct and consequently designed to send signals indicating the values of pressure and temperature of the fluid taken in by the engine to an electronic control unit.

BRIEF DESCRIPTION OF THE FIGURES

The invention will now be described with reference to the annexed figures, which are provided purely by way of non-limiting example and in which.

DETAILED DESCRIPTION OF THE INVENTION

Figure 2:
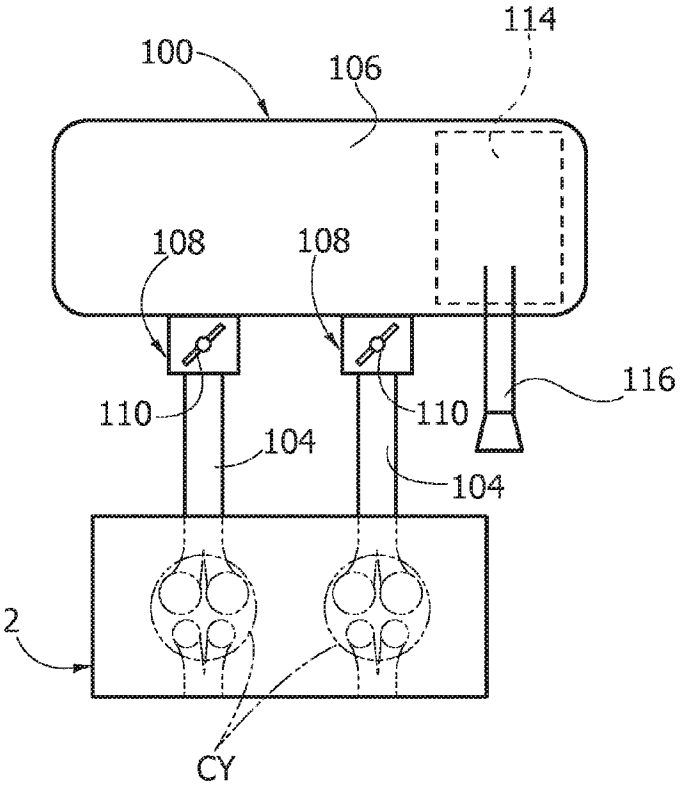
FIG. 2 is a schematic view of an embodiment not forming part of the present invention, but the description of which is in any case useful for an understanding of the invention.
Figure 1:
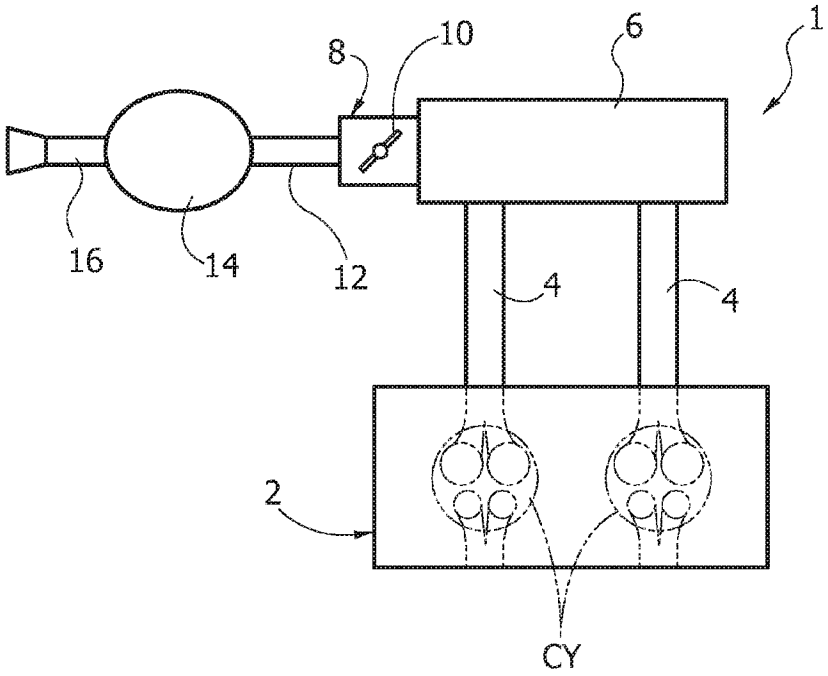
FIG. 1, which has been described previously, is a schematic view of an intake assembly of a known type, coupled to an internal-combustion engine.

In FIG. 2, the reference number 100 designates an intake assembly according to various embodiments of the invention. Any components that may have already been identified in the foregoing description will be designated by the same reference numbers.

The intake assembly 100 can be coupled to the internal-combustion engine 2 and comprises, for each cylinder CY, an intake duct 104 in fluid communication with an airbox 106 by means of a throttle body 108. Each throttle body 108 comprises inside it a throttle valve 110.

Housed within the airbox 106 is a filter element 114, and an intake mouth 116 provided on the airbox 106 is directly in view of the aforesaid filter element 114 and is set upstream thereof and in fluid communication therewith. The intake mouth 116 may possibly be provided by means of a short stretch of duct coming under the airbox 106.

Figure 3:
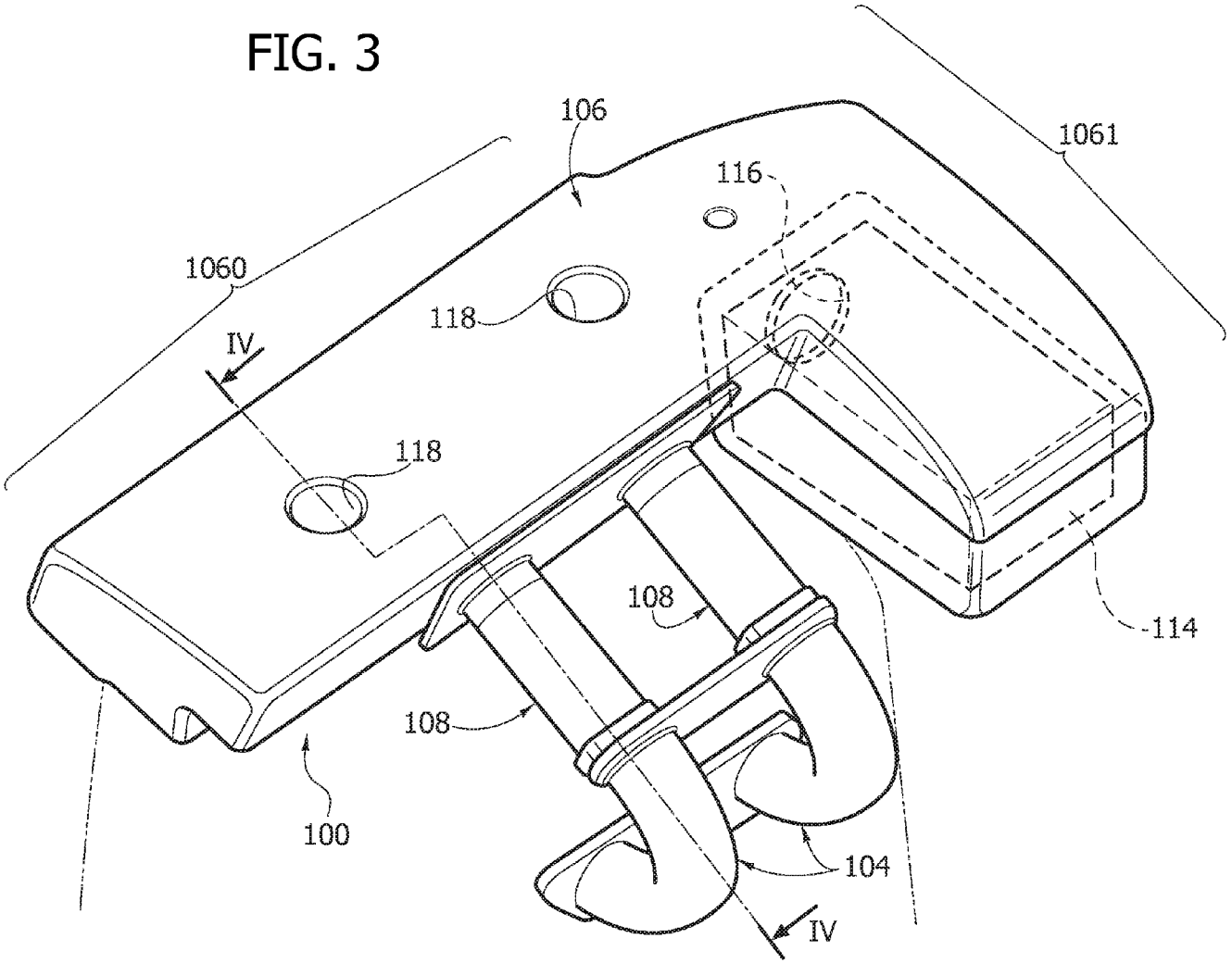
FIG. 3 is a perspective view of a further embodiment of the intake assembly of FIG. 2, which does not form part of the invention either.
Figure 4:
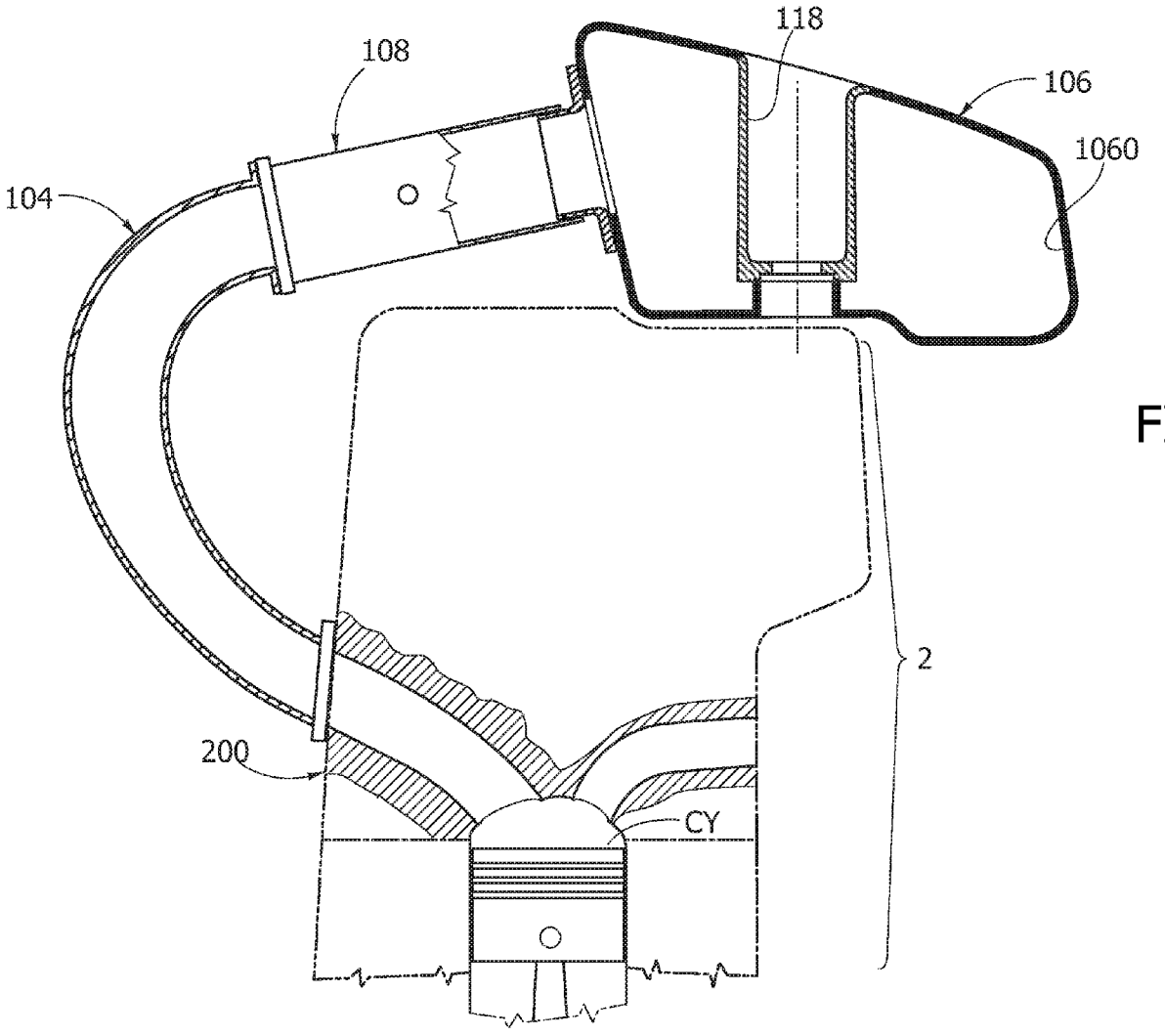
FIG. 4 is a cross-sectional view along the line of trace IV-IV of the intake assembly of FIG. 3 coupled to an internal-combustion engine, which is also sectioned and with some components removed for reasons of clarity.

With reference to FIGS. 3, 4, in a preferred embodiment of the intake assembly 1, the airbox 106 develops with a substantially L-shaped geometry that bestows on it a substantially two-volume structure. More precisely, the airbox 106 comprises:

- a first volume 1060, coming under which are the intake ducts 104 by means of the throttle bodies 108, and which develops substantially in a direction parallel to the array of the intake ducts 104; and
- a second volume 1061, which has an orientation substantially transverse with respect to the first volume 1060 and a smaller extension, and housed within which is the filter element 114; the intake mouth 106 is in fluid communication with the second volume 1061.

In any case, the solution presented in FIGS. 3, 4 is to be assumed as one of the possible examples. Generalizing, the airbox 106 (which, as has been said, according to the present invention, has also function of box for housing the filter element), can assume various shapes according to the overall dimensions available and must be in any case characterized in that the two volumes (one upstream and one downstream of the filter element) behave fluid-dynamically as a single large volume.

Giving out on the airbox 106, as described, are the two throttle bodies, which can be actuated by a single command synchronously and from which there branch off the two—in this embodiment—mutually independent intake ducts 104. It should moreover be noted that, functionally, each ensemble comprising an intake duct 104 and the respective throttle body 108 in turn defines an independent intake manifold so that, in the embodiment illustrated by way of example herein, two independent intake manifolds are present.

With reference to FIG. 4, in this embodiment, the intake ducts 104 are substantially "C"-shaped and are fixed—at a first end—to a cylinder head 200 of the internal-combustion engine 2 so as to connect up with further stretches of intake duct provided in the cylinder head of the internal-combustion engine, as is known to the person skilled in the branch.

The curved shape of the intake ducts 104 is such that they substantially embrace part of the cylinder head 200 of the internal-combustion engine 2. A second end of each intake duct 104 is fixed to a corresponding throttle body 108, which is in turn fixed to the airbox 108 and is in fluid communication therewith. Each throttle body is here configured as a stretch of cylindrical duct, set within which is the throttle valve 110 and which is designed to set up a fluid communication between the ducts 104 and the airbox 106. The latter is designed to be fixed on the top of the cylinder head 200 of the internal-combustion engine 2 by means of screws entering holes 118 that traverse the airbox 106 and engaging in the cylinder head 200.

It should be noted, in any case, that the arrangement of the airbox 106 illustrated in FIGS. 3 and 4, where the filter element 114 is set above the engine, is not in any case a binding element in so far as the teaching of the present invention can be applied also to the case where the filter box is arranged on board the body.

Operation of the intake assembly 100 is described in what follows.

During operation of the internal-combustion engine 2 a flow of air is taken in through the intake mouth 116, is filtered by the filter element 114, and enters the airbox 106.

From the airbox 106 the air is sent on towards the intake ducts 104 through the throttle valves 110 of each throttle body 108, and then proceeds towards the cylinders CY of the internal-combustion engine 2.

Regulation of the flow rate taken in occurs, given the arrangement of the throttle bodies 108 (and hence of the throttle valves 110), downstream of the airbox 106.

Arrangement of the throttle valves 110 fluid-dynamically downstream of the airbox 106 enables amplification of the effect of the pressure waves that are set up within the intake assembly 100, enhancing tuning of the ducts 104 and improving the volumetric efficiency of the internal-combustion engine.

This occurs since the section of the intake assembly 100 within which reflection of the pressure waves takes place is the one basically comprised between the facing section between the duct 104 and the filter box 106 in the area of the throttle valve 110 and the one or more intake valves associated to each cylinder CY, downstream of the corresponding intake duct 104. It should be noted that the ends are the same also in the case of the intake assembly 1, but in the intake assembly 100 the path no longer comprises the airbox.

This means that the reflection of the pressure waves is not conditioned by the presence of the localized capacity represented by the volume of the airbox, as instead occurs in the intake assembly 1 and moreover the desired amplitude of the pressure waves is greater thanks to the large volume of expansion guaranteed by the filter box.

The result is an increase of the volumetric efficiency and of the torque supplied by the internal-combustion engine. The inventors have found experimentally that said increase is in the region of 3-8% as compared to the same engine equipped with a traditional intake assembly, for example the assembly 1.

According to an advantageous aspect of the present invention, the throttle valves 110 of the throttle bodies 108 can be connected mechanically and actuated by means of a common actuator device, for example a single electric motor, in order to reduce the costs of production of the intake assembly 100.

Of course, in the case where the requirements were different, it is possible to actuate independently each throttle valve 110.

Figure 5:
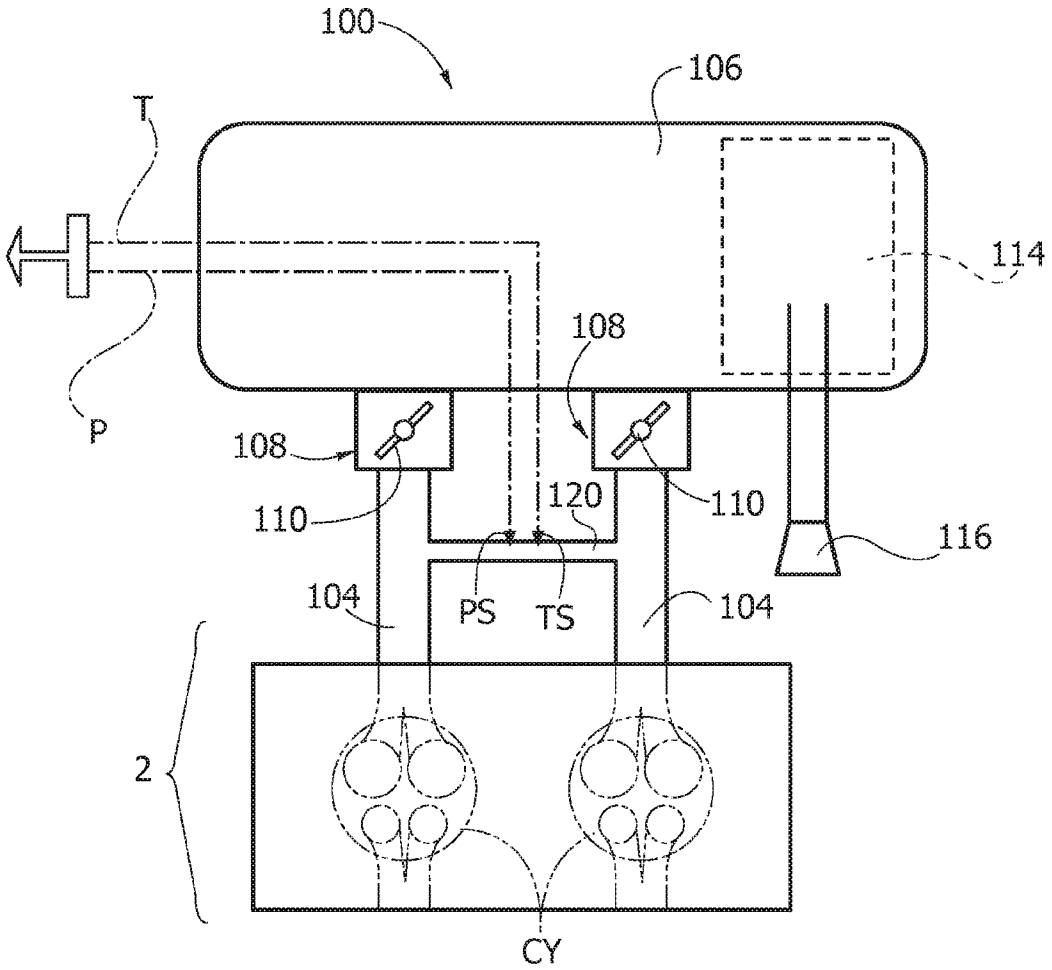
FIG. 5 is an enlarged schematic view corresponding to that of FIG. 2 but illustrating a functional assembly according to an advantageous aspect of the present invention.

Moreover, with reference to FIG. 5, according to a further advantageous aspect of the invention, the intake assembly 100 is provided with monitoring channels 120 that connect adjacent pairs of intake ducts 104. In this embodiment, where the number of cylinders CY is equal to two, the two ducts 104 are connected by a single monitoring channel 120.

In the field of management of the internal-combustion engine 2, there is the need to know the values of pressure and temperature of the fluid entering the engine. In the perspective of reduction of the costs, it is conveniently possible to install a pressure sensor PS and a temperature sensor TS on the monitoring channel 120. In this way, by saving on the set of sensors provided on board the internal-combustion engine 2 and perturbing in a way altogether negligible the dynamics of the fluid within the intake ducts 104, it is possible to know the values of pressure and temperature P, T of the fluid taken in and send them on to an electronic control unit of the engine 2. Alternatively, the pressure sensor can be located in the monitoring duct 120, whereas the temperature sensor can be located in the airbox 106, in an area adjacent to the intake ducts 104.

Figure 6:
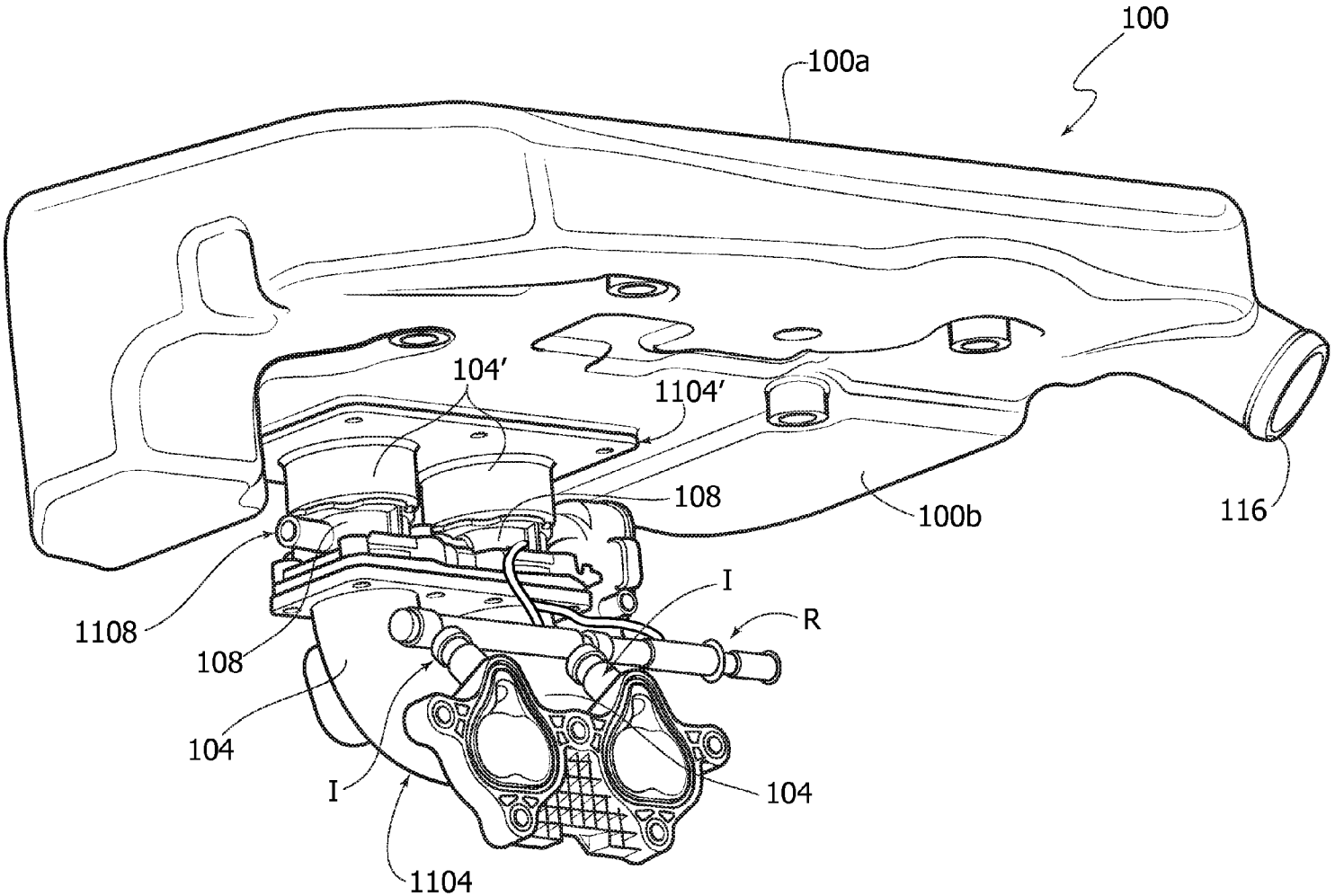
FIGS. 6 and 7 are a perspective view and a partially sectioned perspective view of a further embodiment according to the invention.
Figure 7:
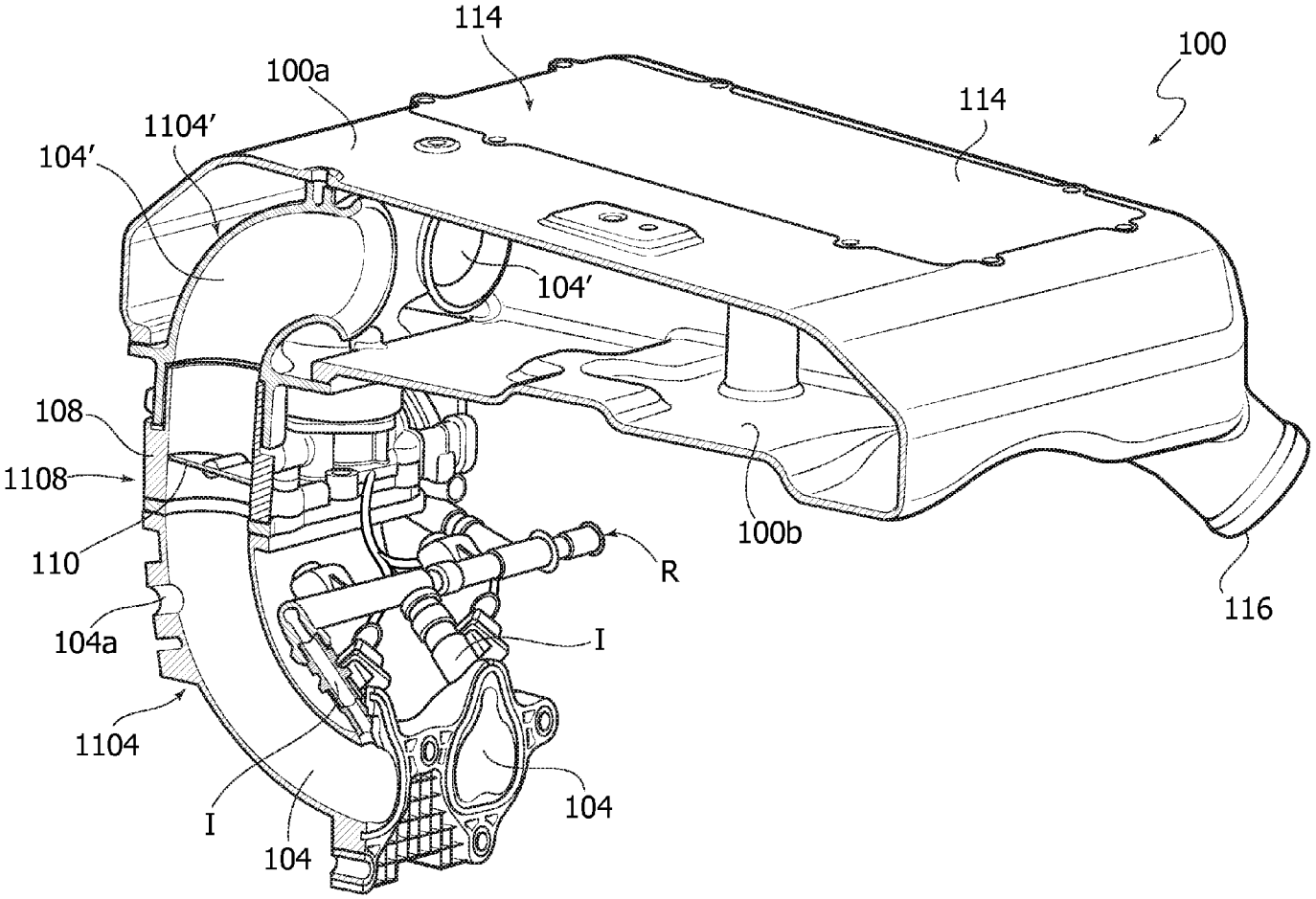

FIGS. 6 and 7 show a further embodiment of the assembly according to the invention, illustrated only schematically in FIG. 5. In said figures, the parts that are in common or correspond to those of FIG. 5 are designated by the same reference numbers.

Also the intake assembly 100 of FIGS. 6 and 7 is pre-arranged for a two-cylinder four-stroke engine. Also in this case, a monitoring duct 120 is provided, which in the specific case is obtained with a flexible pipe (not illustrated) having its ends inserted in a fluid-tight way within corresponding holes 104*a* (just one of which is visible, sectioned, in FIG. 7) made in the walls of the ducts 104.

As described above, the duct 120 is configured for perturbing in an altogether negligible way the dynamics of the fluid inside the intake ducts 104, so that the pressure sensor PS (not visible in FIGS. 6, 7) and possibly the temperature sensor TS (not visible in FIGS. 6, 7 either) that are associated to the monitoring duct 120, in a way similar to what is illustrated in FIG. 5, are able to monitor the pressure and temperature within said monitoring duct and consequently to send signals indicating the values of pressure and temperature P, T of the fluid taken in by the engine to an electronic control unit. Since, as has been said, the monitoring duct 120 perturbs only in a negligible way the flows within the intake ducts 104, within the monitoring duct 120 there is a substantially zero flowrate of fluid. Consequently, the value of pressure within said duct is practically identical to the value of pressure within the intake ducts. As indicated, in the monitoring duct 120 there may be provided also a temperature sensor TS, but alternatively it is envisaged to position the sensor TS within the airbox 106, in an area adjacent to the intake ducts 104. The temperature and pressure sensors necessary for monitoring the engine operating conditions can thus be associated to the duct 120 and/or to the airbox 106 instead of being set inside the engine or inside the intake ducts 104, with consequent simplification of the structure of the engine and of the assembly operations.

In the case of the concrete embodiment that is illustrated in FIGS. 6 and 7, it has been found that to obtain said condition it is necessary for the diameter of the monitoring duct 120 not to be greater than 1/10 of the diameter of each intake duct 104.

With reference once again to FIGS. 6, 7, in this case the airbox 100 has a hollow body, with a major plane surface 100*a* and a minor plane surface 100*b*. The filtering element 114 has an independent casing 114*a* received in a seat of said hollow body of the airbox 100 and having a major surface and a minor surface, both of which are plane and are set substantially flush with the major and minor surfaces 100*a*, 100*b* of the body of the airbox 100.

Once again with reference to FIGS. 6 and 7, the two intake ducts have stretches 104 set downstream of the respective throttle bodies 108, which form part of a single body of plastic material 1104 and have curved conformations identical to one another that extend for an arc of approximately 90°. The two ducts 104 are parallel and set at a distance apart and have their walls rigidly connected together at the ends.

The throttle bodies 108 form part of a single assembly 1108, made of metal or plastic material, set between the aforesaid downstream stretches 104 of the two intake ducts and upstream stretches 104' that come out of the bottom wall 100*b* of the airbox 100. As is clearly visible in FIG. 7, the aforesaid stretches 104' of the intake ducts that are set upstream of the throttle bodies 108 project within the airbox. In the example illustrated, also the upstream stretches 104' of the intake ducts have identical curved conformations that extend for an arc of approximately 90°, in such a way that one end of said ducts comes out vertically from the bottom wall of the airbox 100, whereas the opposite end extends horizontally within the airbox 100. Also said upstream stretches 104' of the intake ducts form part of a single body 1104' of plastic material.

FIGS. 6, 7 also show the fuel injectors I associated to the two ducts 104 and the corresponding supply rail R.

Of course, the details of construction and the embodiments may vary widely with respect to what has been described and illustrated herein, without thereby departing from the sphere of protection of the present invention, as defined by the annexed claims.

What is claimed is:

1. An intake assembly for a two cylinder four stroke internal-combustion engine, wherein the intake assembly includes:

a plurality of intake ducts, each intake duct of said plurality of intake ducts connected to a cylinder of a two cylinder four stroke internal-combustion engine, and an airbox defining a volume, said airbox in fluid communication with each duct of said plurality of intake ducts, said airbox in fluid communication with the external environment by an intake mouth and comprising a filter element inside said airbox, said filter filtering a flow of fluid taken in by the internal-combustion engine through said intake mouth;

said airbox comprising a hollow body having an upper surface and a lower surface bounding an internal cavity, said filter element having an independent casing received in a seat of said hollow body and having an upper filter surface and a lower filter surface substantially flush with said upper surface and said lower surface of said hollow body;

each intake duct of said plurality of intake ducts being in fluid communication with said airbox by a separate throttle body including a throttle valve operable for regulating a flow rate of fluid taken in by the internal-combustion engine, said throttle body being located between said airbox and each intake duct of said plurality of intake ducts;

a monitoring duct directly connected to each intake duct of said plurality of intake ducts such that each intake duct of said plurality of intake ducts is in fluid communication with each other intake duct of said plurality of intake ducts, and said monitoring duct having a cross section having a diameter not greater than 1/10 of a diameter of a cross section of each intake duct of said plurality of intake ducts and a measurement of a pressure in said monitoring duct is about identical to a second measurement in each duct of said plurality of intake ducts;

said plurality of intake ducts comprise a first intake duct and a second intake duct, said first intake duct and said second intake duct each having downstream stretches located downstream of each separate throttle body, said first intake duct and said second intake duct forming a single body of plastic material and have curved shapes identical to one another that extend for an arc of approximately 90°, said first intake duct and said second intake duct being parallel and set at a distance apart and having walls thereof rigidly joined at ends thereof and having respective transverse holes receiving said monitoring duct;

a pressure-sensor associated to said monitoring duct for monitoring the pressure within said monitoring duct and designed to send signals indicating a value of the pressure of the fluid taken in by the engine to an electronic control unit; and a temperature-sensor associated to said monitoring duct for monitoring the temperature of the fluid inside said monitoring duct and sending signals indicating the value of temperature of the fluid taken in by the engine to an electronic control unit.

2. The intake assembly according to claim 1, wherein throttle valves of each said throttle body are mechanically connected and operable by a common actuator device.

3. The intake assembly according to claim 1, wherein said plurality of intake ducts and each said throttle body comprise two independent intake manifolds, each manifold of said manifolds consisting of an intake duct of said plurality of intake ducts and the separate throttle body in fluid communication therewith.

4. The intake assembly according to claim 1, wherein said airbox is substantially L-shaped and comprises:

a first volume, which extends parallel to an array of said plurality of intake ducts and connected to which are said throttle bodies; and a second volume, housed within which is said filter element, said second volume being substantially orthogonal to said first volume.

5. The intake assembly according to claim 4, wherein said first volume is traversed by holes designed to house elements for fixing said airbox to said internal combustion engine.

6. The intake assembly according to claim 1, wherein said first and second intake duct are configured to be coupled to a four-stroke two-cylinder engine.

7. The intake assembly according to claim 1, wherein said temperature-sensor is set inside said airbox in an area adjacent to said intake ducts.

8. An intake assembly for an internal combustion engine comprising a plurality of cylinders, wherein the intake assembly includes:

a plurality of intake ducts, each intake duct of said plurality of intake ducts connected to a cylinder of a plurality of cylinders of an internal-combustion engine, and an airbox defining an interior volume, said airbox in fluid communication with each duct of said plurality of intake ducts;

said airbox in fluid communication with the external environment by an intake mouth and comprising a filter element inside said airbox, said filter designed for filtering a flow of fluid taken in by the internal-combustion engine;

said airbox comprising a hollow body having an upper surface and a lower surface bounding an internal cavity, said filter element having an independent casing received in a seat of said hollow body and having an upper filter surface and a lower filter surface substantially flush with said upper surface and said lower surface of said hollow body;

said airbox substantially L-shaped and comprising a first volume extending parallel to an array of said plurality of intake ducts and a second volume, receiving said filter element therein, said second volume substantially orthogonal to said first volume;

each intake duct of said plurality of intake ducts being in fluid communication with said airbox by a separate throttle body including a throttle valve operable for regulating a flow rate of fluid taken in by the internal-combustion engine, said throttle body being located between said airbox and each intake duct of said plurality of intake ducts, each said throttle body connected to said first volume;

each intake duct coupled to a four-stroke two-cylinder engine;

a monitoring duct directly connected to each intake duct of said plurality of intake ducts such that each intake duct of said plurality of intake ducts is in fluid communication with each other intake duct of said plurality intake ducts;

a temperature-sensor associated to said monitoring duct for monitoring the temperature of the fluid inside said monitoring duct and sending signals indicating the value of the temperature of the fluid taken in by the engine to an electronic control unit, said temperature-sensor is set inside said airbox in an area adjacent to said intake ducts;

an intake duct extension portion extending from each throttle body into said interior volume of said airbox, said intake duct extension portion extending for an arc of approximately 90°, in such a way that an axis of a first end of said intake duct extension portion projects vertically from a bottom wall of said airbox and a second axis of an opposite end of said intake duct extension portion extends horizontally inside said airbox, wherein each intake duct extension portion has a shape identical to each other intake duct extension portion; wherein said monitoring duct has a cross section having a diameter not greater than 1/10 of a diameter of a cross section of each intake duct of said plurality of intake ducts.

9. The intake assembly according to claim 8, wherein said plurality of intake ducts comprise downstream stretches set downstream of the respective throttle bodies and have curved shapes identical to one another that extend for an arc of approximately 90°, the two ducts being parallel and set at a distance apart and having their walls rigidly joined at the ends and having respective transverse holes connected to said monitoring duct.

10. The intake assembly according to claim 9, wherein the throttle bodies associated to the two intake ducts form part of a single assembly set between said downstream stretches of the two intake ducts and upstream stretches of the intake ducts that come out of the bottom wall of the airbox.

11. The intake assembly according to claim 10, wherein said stretches of the intake ducts that are set upstream of the throttle bodies project within the airbox.

12. The intake assembly according to claim 11, wherein said upstream stretches of the intake ducts have identical curved conformations that extend for an arc of approximately 90°, in such a way that one end of said ducts comes out vertically from the bottom wall of the airbox, whereas the opposite end extends horizontally inside the airbox.

13. The intake assembly according to claim 12, wherein said upstream stretches of the intake ducts form part of a single body of plastic material.

* * * * *